US008670981B2

(12) United States Patent
Vos et al.

(10) Patent No.: US 8,670,981 B2
(45) Date of Patent: Mar. 11, 2014

(54) SPEECH ENCODING AND DECODING UTILIZING LINE SPECTRAL FREQUENCY INTERPOLATION

(75) Inventors: Koen Bernard Vos, San Francisco, CA (US); Karsten Vandborg Sorensen, Stockholm (SE); Soren Skak Jensen, Stockholm (SE)

(73) Assignee: Skype, Dublin (IE)

( * ) Notice: Subject to any disclaimer, the term of this patent is extended or adjusted under 35 U.S.C. 154(b) by 892 days.

(21) Appl. No.: 12/455,752

(22) Filed: Jun. 5, 2009

(65) Prior Publication Data

US 2010/0174532 A1 Jul. 8, 2010

(30) Foreign Application Priority Data

Jan. 6, 2009 (GB) ..... 0900140.5

(51) Int. Cl.
*G10L 19/00* (2013.01)

(52) U.S. Cl.
USPC ..... 704/205

(58) Field of Classification Search
USPC ..... 704/205
See application file for complete search history.

(56) References Cited

U.S. PATENT DOCUMENTS

| | | | | |
|---|---|---|---|---|
| 4,857,927 | A | 8/1989 | Takabayashi | |
| 5,125,030 | A | 6/1992 | Nomura et al. | |
| 5,240,386 | A * | 8/1993 | Amin et al. | 417/243 |
| 5,253,269 | A | 10/1993 | Gerson et al. | |
| 5,327,250 | A | 7/1994 | Ikeda | |
| 5,357,252 | A | 10/1994 | Ledzius et al. | |
| 5,487,086 | A | 1/1996 | Bhaskar | |
| 5,646,961 | A | 7/1997 | Shoham et al. | |
| 5,649,054 | A | 7/1997 | Oomen et al. | |
| 5,680,508 | A | 10/1997 | Liu | |
| 5,699,382 | A | 12/1997 | Shoham et al. | |
| 5,774,842 | A | 6/1998 | Nishio et al. | |
| 5,867,814 | A * | 2/1999 | Yong | 704/216 |
| 6,104,992 | A * | 8/2000 | Gao et al. | 704/220 |
| 6,122,608 | A | 9/2000 | McCree | |

(Continued)

FOREIGN PATENT DOCUMENTS

| | | |
|---|---|---|
| CN | 1255226 | 5/2000 |
| CN | 1337042 | 2/2002 |

(Continued)

OTHER PUBLICATIONS

"International Search Report and Written Opinion", Application No. PCT/EP2010/050060, (Apr. 14, 2010), 14 pages.

(Continued)

*Primary Examiner* — Michael N Opsasnick
(74) *Attorney, Agent, or Firm* — Sonia Cooper; Jim Ross; Micky Minhas

(57) ABSTRACT

A method, system and program for encoding and decoding speech according to a source-filter model whereby speech is modelled to comprise a source signal filtered by a time-varying filter. The method comprises: receiving a speech signal comprising successive frames, for each of a plurality of frames of the speech signal, deriving a first line spectral frequency vector for a first portion of the frame, and a second line spectral frequency vector for a second portion of the frame, and determining a transmit line spectral frequency vector and an interpolation factor based on the first and second line spectral frequency vectors, and on the transmit line spectral frequency vector for a preceding one of the frames.

23 Claims, 7 Drawing Sheets

(56) References Cited

U.S. PATENT DOCUMENTS

| | | | | |
|---|---|---|---|---|
| 6,173,257 | B1 * | 1/2001 | Gao | 704/220 |
| 6,188,980 | B1 * | 2/2001 | Thyssen | 704/230 |
| 6,260,010 | B1 * | 7/2001 | Gao et al. | 704/230 |
| 6,363,119 | B1 | 3/2002 | Oami | |
| 6,408,268 | B1 | 6/2002 | Tasaki | |
| 6,456,964 | B2 | 9/2002 | Manjunath et al. | |
| 6,470,309 | B1 | 10/2002 | McCree | |
| 6,493,665 | B1 * | 12/2002 | Su et al. | 704/230 |
| 6,502,069 | B1 | 12/2002 | Grill et al. | |
| 6,523,002 | B1 | 2/2003 | Gao et al. | |
| 6,574,593 | B1 | 6/2003 | Gao et al. | |
| 6,664,913 | B1 | 12/2003 | Craven et al. | |
| 6,751,587 | B2 | 6/2004 | Thyssen et al. | |
| 6,757,649 | B1 * | 6/2004 | Gao et al. | 704/222 |
| 6,757,654 | B1 * | 6/2004 | Westerlund et al. | 704/262 |
| 6,775,649 | B1 | 8/2004 | DeMartin | |
| 6,862,567 | B1 | 3/2005 | Gao | |
| 6,996,523 | B1 * | 2/2006 | Bhaskar et al. | 704/222 |
| 7,136,812 | B2 | 11/2006 | Manjunath et al. | |
| 7,149,683 | B2 | 12/2006 | Jelinek | |
| 7,151,802 | B1 | 12/2006 | Bessette et al. | |
| 7,171,355 | B1 | 1/2007 | Chen | |
| 7,496,505 | B2 | 2/2009 | Manjunath et al. | |
| 7,505,594 | B2 | 3/2009 | Mauro | |
| 7,684,981 | B2 | 3/2010 | Thumpudi et al. | |
| 7,778,476 | B2 | 8/2010 | Alvarez et al. | |
| 7,869,993 | B2 | 1/2011 | Ojala | |
| 7,873,511 | B2 | 1/2011 | Herre et al. | |
| 8,036,887 | B2 | 10/2011 | Yasunaga et al. | |
| 8,069,040 | B2 * | 11/2011 | Vos | 704/222 |
| 8,078,474 | B2 * | 12/2011 | Vos et al. | 704/500 |
| 8,392,178 | B2 | 3/2013 | Vos | |
| 8,396,706 | B2 | 3/2013 | Vos | |
| 8,433,563 | B2 | 4/2013 | Vos | |
| 8,452,606 | B2 | 5/2013 | Vos | |
| 8,463,604 | B2 | 6/2013 | Vos | |
| 2001/0001320 | A1 | 5/2001 | Heinen et al. | |
| 2001/0005822 | A1 | 6/2001 | Fujii et al. | |
| 2001/0039491 | A1 | 11/2001 | Yasunaga et al. | |
| 2002/0032571 | A1 | 3/2002 | Leung et al. | |
| 2002/0099540 | A1 | 7/2002 | Yasunaga et al. | |
| 2002/0120438 | A1 | 8/2002 | Lin | |
| 2003/0200092 | A1 * | 10/2003 | Gao et al. | 704/258 |
| 2004/0102969 | A1 | 5/2004 | Manjunath et al. | |
| 2005/0141721 | A1 | 6/2005 | Aarts et al. | |
| 2005/0278169 | A1 | 12/2005 | Hardwick | |
| 2005/0285765 | A1 | 12/2005 | Suzuki et al. | |
| 2006/0074643 | A1 | 4/2006 | Lee et al. | |
| 2006/0235682 | A1 | 10/2006 | Yasunaga et al. | |
| 2006/0271356 | A1 | 11/2006 | Vos | |
| 2006/0277039 | A1 | 12/2006 | Vos et al. | |
| 2006/0282262 | A1 | 12/2006 | Vos et al. | |
| 2007/0043560 | A1 | 2/2007 | Lee | |
| 2007/0055503 | A1 | 3/2007 | Chu et al. | |
| 2007/0088543 | A1 | 4/2007 | Ehara | |
| 2007/0100613 | A1 | 5/2007 | Yasunaga et al. | |
| 2007/0136057 | A1 | 6/2007 | Phillips | |
| 2007/0225971 | A1 | 9/2007 | Bessette | |
| 2007/0255561 | A1 | 11/2007 | Su et al. | |
| 2008/0004869 | A1 | 1/2008 | Herre et al. | |
| 2008/0015866 | A1 | 1/2008 | Thyssen et al. | |
| 2008/0091418 | A1 | 4/2008 | Laaksonen et al. | |
| 2008/0126084 | A1 | 5/2008 | Lee et al. | |
| 2008/0140426 | A1 | 6/2008 | Kim et al. | |
| 2008/0154588 | A1 | 6/2008 | Gao | |
| 2008/0275698 | A1 | 11/2008 | Yasunaga et al. | |
| 2009/0043574 | A1 | 2/2009 | Gao et al. | |
| 2009/0222273 | A1 | 9/2009 | Massaloux et al. | |
| 2010/0174531 | A1 | 7/2010 | Bernard | |
| 2010/0174532 | A1 | 7/2010 | Vos et al. | |
| 2010/0174534 | A1 | 7/2010 | Vos | |
| 2010/0174541 | A1 | 7/2010 | Vos | |
| 2010/0174542 | A1 | 7/2010 | Vos | |
| 2010/0174547 | A1 | 7/2010 | Vos | |
| 2011/0077940 | A1 | 3/2011 | Vos et al. | |
| 2011/0173004 | A1 | 7/2011 | Bessette et al. | |
| 2013/0262100 | A1 | 10/2013 | Vos | |

FOREIGN PATENT DOCUMENTS

| | | |
|---|---|---|
| CN | 1653521 | 8/2005 |
| EP | 0501421 | 9/1992 |
| EP | 0550990 | 7/1993 |
| EP | 0610906 | 8/1994 |
| EP | 0720145 | 7/1996 |
| EP | 0724252 | 7/1996 |
| EP | 0849724 | 6/1998 |
| EP | 0877355 | 11/1998 |
| EP | 0957472 | 11/1999 |
| EP | 1093116 | 4/2001 |
| EP | 1255244 | 11/2002 |
| EP | 1326235 | 7/2003 |
| EP | 1758101 | 2/2007 |
| EP | 1903558 | 3/2008 |
| GB | 2466669 | 7/2010 |
| GB | 2466670 | 7/2010 |
| GB | 2466671 | 7/2010 |
| GB | 2466672 | 7/2010 |
| GB | 2466673 | 7/2010 |
| GB | 2466674 | 7/2010 |
| GB | 2466675 | 7/2010 |
| JP | 1205638 | 10/1987 |
| JP | 2287400 | 4/1989 |
| JP | 4312000 | 4/1991 |
| JP | 7306699 | 5/1994 |
| JP | 2007279754 | 10/2007 |
| WO | WO-9103790 | 3/1991 |
| WO | WO-9403988 | 2/1994 |
| WO | WO-9518523 | 7/1995 |
| WO | WO-9918565 | 4/1999 |
| WO | WO-9963521 | 12/1999 |
| WO | WO-0103122 | 1/2001 |
| WO | WO-0191112 | 11/2001 |
| WO | WO-03052744 | 6/2003 |
| WO | WO 2005/009019 A2 | 1/2005 |
| WO | WO-2008046492 | 4/2008 |
| WO | WO-2008056775 | 5/2008 |
| WO | WO-2010079163 | 7/2010 |
| WO | WO-2010079164 | 7/2010 |
| WO | WO-2010079165 | 7/2010 |
| WO | WO-2010079166 | 7/2010 |
| WO | WO-2010079167 | 7/2010 |
| WO | WO-2010079170 | 7/2010 |
| WO | WO-2010079171 | 7/2010 |

OTHER PUBLICATIONS

"International Search Report and Written Opinion", Application No. PCT/EP2010/050052, (Jun. 21, 2010), 13 pages.

"International Search Report and Written Opinion", Application No. PCT/EP2010/050057, (Jun. 24, 2010), 11 pages.

"International Search Report and Written Opinion", Application No. PCT/EP2010/050061, (Apr. 12, 2010), 13 pages.

"International Search Report and Written Opinion", Application No. PCT/EP2010/050051, (Mar. 15, 2010), 13 pages.

"International Search Report and Written Opinion", Application No. PCT/EP2010/050056, (Mar. 29, 2010), 8 pages.

"Non-Final Office Action", U.S. Appl. No. 12/455,632, (Feb. 6, 2012), 18 pages.

"Non-Final Office Action", U.S. Appl. No. 12/586,915, (May 8, 2012), 10 pages.

"Notice of Allowance", U.S. Appl. No. 12/455,632, (May 15, 2012), 7 pages.

"Search Report", Application No. GB 0900139.7, (Apr. 17, 2009), 3 pages.

"Search Report", Application No. GB 0900141.3, (Apr. 30, 2009), 3 pages.

"Search Report", Application No. GB 0900142.1, (Apr. 21, 2009), 2 pages.

"Search Report", Application No. GB 0900144.7, (Apr. 24, 2009), 2 pages.

(56) References Cited

OTHER PUBLICATIONS

"Search Report", Application No. GB0900143.9, (Apr. 28, 2009), 1 page.
"Search Report", Application No. GB0900145.4, (Apr. 27, 2009), 1 page.
"Wideband Coding of Speech at Around 1 kbit/s Using Adaptive Multi-rate Wideband (AMR-WB)", *International Telecommunication Union* G.722.2, (2002), pp. 1-65.
Bishnu, S et al., "Predictive Coding of Speech Signals and Error Criteria", *IEEE, Transactions on Acoustics, Speech and Signal Processing*, ASSP 27(3), (1979), pp. 247-254.
Chen, Juin-Hwey "Novel Codec Structures for Noise Feedback Coding of Speech", *IEEE*, (2006), pp. 681-684.
Denckla, Ben "Subtractive Dither for Internet Audio", *Journal of the Audio Engineering Society*, vol. 46, Issue 7/8, (Jul. 1998), pp. 654-656.
Gerzon, et al., "A High-Rate Buried-Data Channel for Audio CD", Journal of Audio Engineering Society, vol. 43, No. 1/2,(Jan. 1995), 22 pages.
Haagen, J et al., "Improvements in 2.4 KBPS High-Quality Speech Coding", *IEEE*, (Mar. 1992), pp. 145-148.
Jayant, N S., et al., "The Application of Dither to the Quantization of Speech Signals", *Program of the 84th Meeting of the Acoustical Society of America*. (*Abstract Only*), (Nov.-Dec. 1972), pp. 1293-1304.
Lupini, Peter et al., "A Multi-Mode Variable Rate Celp Coder Based on Frame Classification", *Proceedings of the International Conference on Communications* (*ICC*), *IEEE 1* (1993), pp. 406-409.
Mahe, G et al., "Quantization Noise Spectral Shaping in Instantaneous Coding of Spectrally Unbalanced Speech Signals", *IEEE, Speech Coding Workshop*, (2002), pp. 56-58.
Makhoul, John et al., "Adaptive Noise Spectral Shaping and Entropy Coding of Speech", (Feb. 1979), pp. 63-73.
Rao, A V., et "Pitch Adaptive Windows for Improved Excitation Coding in Low-Rate CELP Coders", *IEEE Transactions on Speech and Audio Processing*, (Nov. 2003), pp. 648-659.
Chen, L., et al., "Subframe Interpolation Optimized Coding of LSF Parameters," *IEEE*, pp. 725-728 (Jul. 2007).
Ferreira, C.R., et al., "Modified Interpolation of LSFs based on Optimization of Distortion Measures," *IEEE*, pp. 777-782 (Sep. 2006).
Islam, T., et al., "Partial-Energy Weighted Interpolation of Linear Prediction Coefficients," *IEEE*, pp. 105-107 (Sep. 2000).
International Telecommunication Union, ITU-T: "Coding of Speech at 8 kbit/s Using Conjugate-Structure Algebraic-Code-Excited Linear-Prediction (CS-ACELP)", 39 pages, (1996).
Notification of Transmittal of International Search Report and the Written Opinion issued in International Application No. PCT/EP2010/050053, dated May 17, 2010, including copies of the International Search Report completed Apr. 29, 2010, and the Written Opinion.
Martins da Silva, L., et al., "Interpolation-Based Differential Vector Coding of Speech LSF Parameters," *IEEE*, pp. 2049-2052 (Nov. 1996).
Salami, R., "Design and Description of CS-ACELP: A Toll Quality 8 kb/s Speech Coder," *IEEE*, 6(2):116-130 (Mar. 1998).
"Non-Final Office Action", U.S. Appl. No. 12/455,100, (Jun. 8, 2012), 8 pages.
"Non-Final Office Action", U.S. Appl. No. 12/455,632, (Oct. 18, 2011), 14 pages.
"Final Office Action", U.S. Appl. No. 12/455,478, (Jun. 28, 2012), 8 pages.
"Foreign Office Action", GB Application No. 0900145.4, (May 28, 2012), 2 pages.
"Non-Final Office Action", U.S. Appl. No. 12/455,157, (Aug. 6, 2012), 15 pages.
"Non-Final Office Action", U.S. Appl. No. 12/455,632, (Aug. 22, 2012), 14 pages.
"Non-Final Office Action", U.S. Appl. No. 12/455,712, (Jun. 20, 2012), 8 pages.
"Final Office Action", U.S. Appl. No. 12/583,998, (May 20, 2013), 19 pages.
"Non-Final Office Action", U.S. Appl. No. 12/455,632, (Jun. 4, 2013), 13 pages.
"Supplemental Notice of Allowance", U.S. Appl. No. 12/455,100, (May 16, 2013), 2 pages.
"Foreign Office Action", Chinese Application No. 201080010209, (Jan. 30, 2013), 12 pages.
"Supplemental Notice of Allowance", U.S. Appl. No. 12/455,100, (Apr. 4, 2013), 2 pages.
"Supplemental Notice of Allowance", U.S. Appl. No. 12/455,478, (Mar. 28, 2013), 3 pages.
"Examination Report under Section 18(3)", Great Britain Application No. 0900143.9, (May 21, 2012), 2 pages.
"Examination Report", GB Application No. 0900140.5, (Aug. 29, 2012), 3 pages.
"Examination Report", GB Application No. 0900141.3, (Oct. 8, 2012), 2 pages.
"Final Office Action", U.S. Appl. No. 12/455,100, (Oct. 4, 2012), 5 pages.
"Final Office Action", U.S. Appl. No. 12/455,632, (Jan. 18, 2013), 15 pages.
"Foreign Office Action", CN Application No. 201080010208.1, (Dec. 28, 2012), 7 pages.
"Non-Final Office Action", U.S. Appl. No. 12/583,998, (Oct. 18, 2012), 16 pages.
"Non-Final Office Action", U.S. Appl. No. 12/586,915, (Sep. 25, 2012), 10 pages.
"Notice of Allowance", U.S. Appl. No. 12/455,100, (Feb. 5, 2013), 4 Pages.
"Notice of Allowance", U.S. Appl. No. 12/455,157, (Nov. 29, 2012), 9 pages.
"Notice of Allowance", U.S. Appl. No. 12/455,478, (Dec. 7, 2012), 7 pages.
"Notice of Allowance", U.S. Appl. No. 12/455,712, (Oct. 23, 2012), 7 pages.
"Notice of Allowance", U.S. Appl. No. 12/586,915, (Jan. 22, 2013), 8 pages.
"Search Report", GB Application No. 0900140.5, (May 5, 2009),3 pages.
"Supplemental Notice of Allowance", U.S. Appl. No. 12/455,157, (Jan. 22, 2013), 2 pages.
"Supplemental Notice of Allowance", U.S. Appl. No. 12/455,157, (Feb. 8, 2013), 2 pages.
"Supplemental Notice of Allowance", U.S. Appl. No. 12/455,478, (Jan. 11, 2013), 2 pages.
"Supplemental Notice of Allowance", U.S. Appl. No. 12/455,712, (Dec. 19, 2012), 2 pages.
"Supplemental Notice of Allowance", U.S. Appl. No. 12/455,712, (Jan. 14, 2013), 2 pages.
"Supplemental Notice of Allowance", U.S. Appl. No. 12/455,712, (Feb. 5, 2013), 2 pages.
"Non-Final Office Action", U.S. Appl. No. 13/905,864, (Aug. 15, 2013), 6 pages.
"Notice of Allowance", U.S. Appl. No. 12/455,632, (Oct. 9, 2013), 8 pages.
"Notice of Allowance", U.S. Appl. No. 13/905,864, (Sep. 17, 2013), 5 pages.
"Supplemental Notice of Allowance", U.S. Appl. No. 13/905,864, Jan. 3, 2014, 2 pages.

* cited by examiner

SPEECH ENCODING AND DECODING UTILIZING LINE SPECTRAL FREQUENCY INTERPOLATION

RELATED APPLICATION

This application claims priority under 35 U.S.C. §119 or 365 to Great Britain Application No. 0900140.5, filed Jan. 6, 2009. The entire teachings of the above application are incorporated herein by reference.

FIELD OF THE INVENTION

The present invention relates to the encoding of speech for transmission over a transmission medium, such as by means of an electronic signal over a wired connection or electromagnetic signal over a wireless connection.

BACKGROUND

A source-filter model of speech is illustrated schematically in FIG. 1*a*. As shown, speech can be modelled as comprising a signal from a source 102 passed through a time-varying filter 104. For "voiced" speech, the source signal represents the immediate vibration of the vocal chords, and the filter represents the acoustic effect of the vocal tract formed by the shape of the throat, mouth and tongue. For "unvoiced" speech, the vocal chords are not utilized and the source becomes more of a noisy signal. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal with each period comprising a series of pulses of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 202 is shown schematically in FIG. 2*a* with a gradually varying period $P_1$, $P_2$, $P_3$, etc., each comprising four pulses which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*.

The spectral envelope signal and the source signal are each encoded separately for transmission. In the illustrated example, each subframe 106 would contain: (i) a set of parameters representing the spectral envelope 204; and (ii) a set of parameters representing the pulses of the source signal 202.

In the illustrated example, each subframe 106 would comprise: (i) a quantised set of LPC parameters representing the spectral envelope, (ii)(a) a quantised LTP vector related to the correlation between pitch-periods in the source signal, and (ii)(b) a quantised LTP residual signal representative of the source signal with the effects of both the inter-period correlation and the spectral envelope removed.

Temporal fluctuations of spectral envelopes can cause perceptual degradation and a loss in coding efficiency. One way to mitigate these negative effects is to shorten the frame size, or frame skip, of the spectral analysis thereby lowering the fluctuations between the spectra. This approach unfortunately leads to a considerably higher transmit bit rate. However, it is desirable to reduce the transmit bit rate.

The coefficients generated by linear predictive coding are very sensitive to errors, and therefore a small error may distort the whole spectrum of the reconstructed signal, or may even result in the prediction filter becoming unstable. Therefore, the transmission of LPC coefficients is often avoided, and the LPC coefficients information is further encoded to provide a more robust parameter set.

To avoid these problems, it is common to represent the LPC coefficients as Line Spectral Pairs (LSP) also known as Line Spectral Frequencies (LSF), which are more robust to small errors introduced during transmission.

Due to the nature of LSFs, it is possible to interpolate between values for adjacent frames. This interpolation results in a smoothing of the signal, thereby reducing the effect of the temporal fluctuations of the spectral envelopes. Interpolation is performed using a fixed interpolation factor, typically having a value of 0.5. In the case for which the interpolation is taken fully into account in the estimation of which vector to transmit, the fixed interpolation factor may provide smoothing of the signal but may potentially lead to lower performance than without the interpolation.

It is an aim of some embodiments of the present invention to address, or at least mitigate, some of the above identified problems of the prior art.

SUMMARY

According to an aspect of the invention, there is provided a method of determining line spectral frequency vectors representing filter coefficients for a time-varying filter for encoding speech according to a source-filter model, whereby speech is modelled to comprise a source signal filtered by the time-varying filter, the method comprising: receiving a speech signal comprising successive frames, for each of a plurality of frames of the speech signal, deriving a first line spectral frequency vector for a first portion of the frame, and a second line spectral frequency vector for a second portion of the frame, and determining a transmit line spectral frequency vector and an interpolation factor based on the first and second line spectral frequency vectors, and on the transmit line spectral frequency vector for a preceding one of the frames.

In embodiments, the first and second line spectral frequency vectors may comprise optimal line spectral frequency vectors for the first and second portions of the frame.

The determining of the transmit line spectral frequency vector and the interpolation factor may comprise minimizing a difference between the second line spectral frequency vector and the transmit line spectral frequency vector and between the first line spectral frequency vector and an interpolated line spectral frequency vector based on the interpolation factor and the transmit line spectral frequency vector. Minimizing the difference may comprise minimizing a residual energy for the frame.

The first portion of the frame may comprise a first half of the frame, and the second portion of the frame may comprise a second half of the frame.

The determining of the transmit line spectral frequency vector and the interpolation factor may comprise alternately calculating the transmit line spectral frequency vector for a constant interpolation factor and then the interpolation factor for the calculated transmit line spectral frequency vector for a plurality of iterations.

The determining of the transmit line spectral frequency vector and the interpolation factor may comprise alternately calculating the transmit line spectral frequency vector for a constant interpolation factor and then the interpolation factor for the calculated transmit line spectral frequency vector until the calculation converges on optimum values for the interpolation factor and the line spectral frequency vector.

The plurality of iterations may comprise a pre-defined number of iterations.

The method may further comprise arithmetically encoding the interpolation factor and the transmit line spectral frequency vector.

The method may further comprise multiplexing the encoded interpolation factor and transmit line spectral frequency vector into a bit stream for transmission.

According to a further aspect of the invention, there is provided a method of decoding line spectral frequency vectors representing filter coefficients for a time-varying filter for encoding speech according to a source-filter model, whereby speech is modelled to comprise a source signal filtered by the time-varying filter, the method comprising receiving an encoded bit stream, the encoded bit stream representing a plurality of successive frames of a speech signal, each frame having a first portion and a second portion, and for each frame of the speech signal: extracting an interpolation factor from the bit stream; extracting line spectral frequency indices from the bit stream and converting the line spectral frequency indices to a received line spectral frequency vector, the received line spectral frequency vector associated with a second portion of the frame; and determining an interpolated line spectral frequency vector associated with a first portion of the frame based on the interpolation factor, the received line spectral frequency vector for the frame, and the received line spectral frequency vector for the previous frame.

A decoded speech signal may be generated based on the received line spectral frequency vector and the interpolated line spectral frequency vector.

According to another aspect of the invention, there is provided an encoder for encoding speech according to a source-filter model whereby speech is modelled to comprise a source signal filtered by a time-varying filter, the encoder comprising: an input arranged to receive a speech signal comprising successive frames, a first signal-processing module configured to derive, for each of a plurality of frames of the speech signal, a first line spectral frequency vector for a first portion of the frame, and a second line spectral frequency vector for a second portion of the frame, and a second signal-processing module configured to determine a transmit line spectral frequency vector and an interpolation factor based on the first and second line spectral frequency vectors, and on the transmit line spectral frequency vector for a preceding one of the frames.

According to another aspect of the invention, there is provided a decoder for decoding an encoded signal comprising speech encoded according to a source-filter model whereby the speech is modelled to comprise a source signal filtered by a time-varying filter, the decoder comprising an input module for receiving an encoded signal over a communication medium, the encoded signal representing a plurality of successive frames of a speech signal, each frame having a first portion and a second portion, and a signal-processing module configured to extract, for each frame of the speech signal, an interpolation factor and line spectral frequency indices from the encoded signal, wherein the signal-processing module is further configured to convert the line spectral frequency indices to a received line spectral frequency vector, the received line spectral frequency vector associated with a second portion of the frame, and to determine an interpolated line spectral frequency vector associated with a first portion of the frame based on the interpolation factor, the received line spectral frequency vector for the frame, and the received line spectral frequency vector for the previous frame.

According to another aspect of the present invention, there is provided a computer program product for determining line spectral frequency vectors representing filter coefficients for a time-varying filter for encoding speech according to a source-filter model, whereby the speech is modelled to comprise a source signal filtered by a time-varying filter, the program comprising code arranged so as when executed on a processor to:

receive a speech signal comprising successive frames;

for each of a plurality of frames of the speech signal, derive a first line spectral frequency vector for a first portion of the frame, and a second line spectral frequency vector for a second portion of the frame; and determine a transmit line spectral frequency vector and an interpolation factor based on the first and second line spectral frequency vectors, and on the transmit line spectral frequency vector for a preceding one of the frames.

According to another aspect of the present invention, there is provided a computer program product for decoding line spectral frequency vectors representing filter coefficients for a time-varying filter for encoding speech according to a source-filter model, whereby the speech is modelled to comprise a source signal filtered by a time-varying filter, the program comprising code arranged so as when executed on a processor to:

receive an encoded bit stream, the encoded bit stream representing a plurality of successive frames of a speech signal, each frame having a first portion and a second portion; and for each frame of the speech signal:

extract an interpolation factor from the bit stream;

extract line spectral frequency indices from the bit stream and convert the line spectral frequency indices to a received line spectral frequency vector, the received line spectral frequency vector associated with a second portion of the frame; and determine an interpolated line spectral frequency vector associated with a first portion of the frame based on the interpolation factor, the received line spectral frequency vector for the frame, and the received line spectral frequency vector for the previous frame.

According to further aspects of the present invention, there are provided corresponding computer program products such as client application products arranged so as when executed on a processor to perform the steps of the methods described above.

According to another aspect of the present invention, there is provided a communication system comprising a plurality of end-user terminals each comprising a corresponding encoder and/or decoder.

BRIEF DESCRIPTION OF THE DRAWINGS

Embodiments of the present invention will now be described by way of example only, and with reference to the accompanying figures, in which.

DETAILED DESCRIPTION OF EMBODIMENTS

Embodiments of the invention are described herein by way of particular examples and specifically with reference to exemplary embodiments. It will be understood by one skilled in the art that the invention is not limited to the details of the specific embodiments given herein.

Embodiments of the invention provide an LSF interpolation scheme which applies a parametric model with a single scalar variable fully describing an additional interpolated LSF vector such that just this single model parameter needs to be transmitted in addition to the already transmitted single LSF vector per frame. The transmitted LSF vector and interpolation parameter are estimated in a joint manner where also the interpolated LSF vector is taken into account.

Embodiments of the present invention deal with high temporal fluctuations of all-pole speech spectral envelopes. At low bit rates, speech spectral envelope fluctuations are known to degrade the perceptual quality more than high absolute modelling error.

Figure 1A:
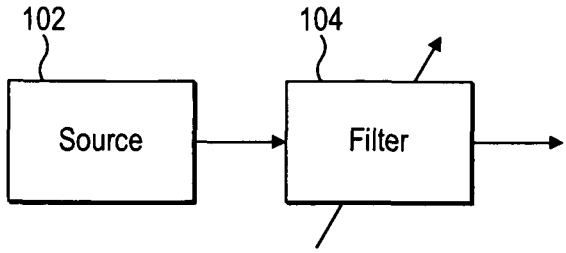
FIG. 1*a* is a schematic representation of a source-filter model of speech.
Figure 1B:
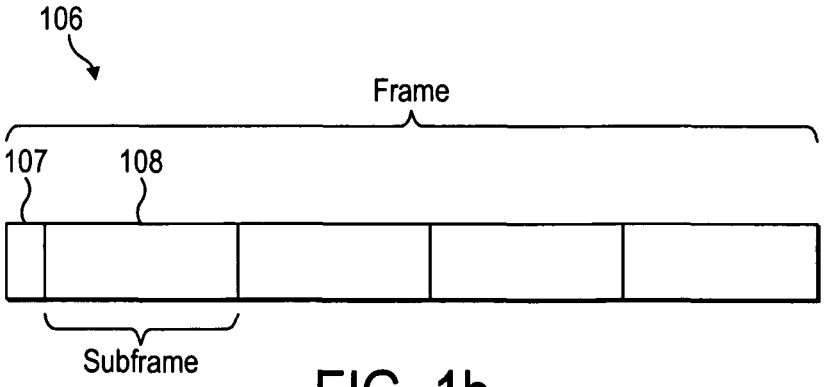
FIG. 1*b* is a schematic representation of a frame.
Figure 2A:
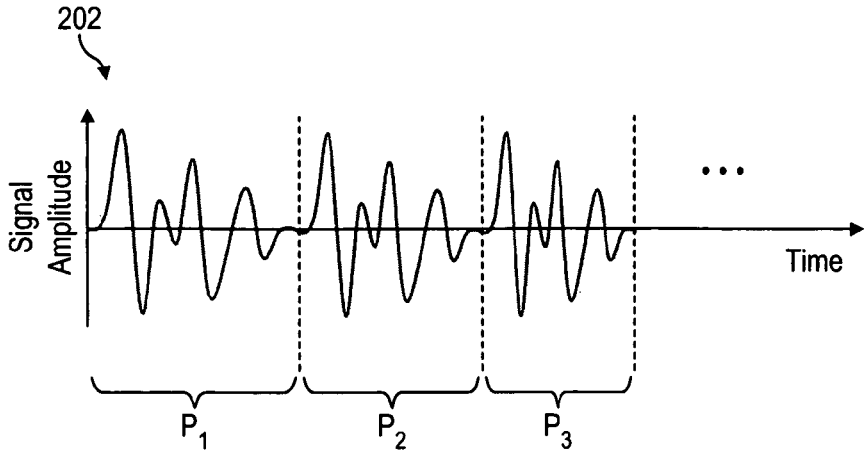
FIG. 2*a* is a schematic representation of a source signal.
Figure 2B:
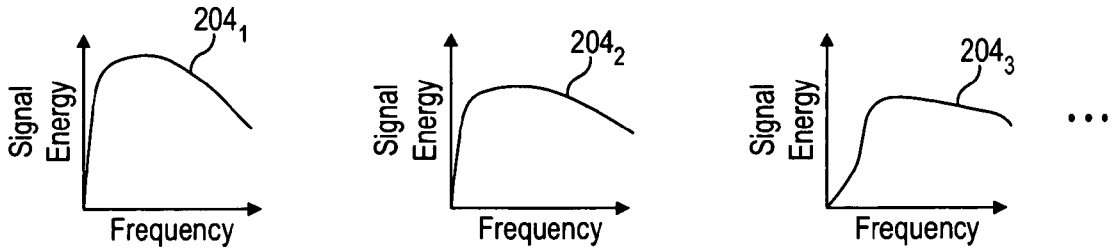
FIG. 2*b* is a schematic representation of variations in a spectral envelope.
Figure 3:
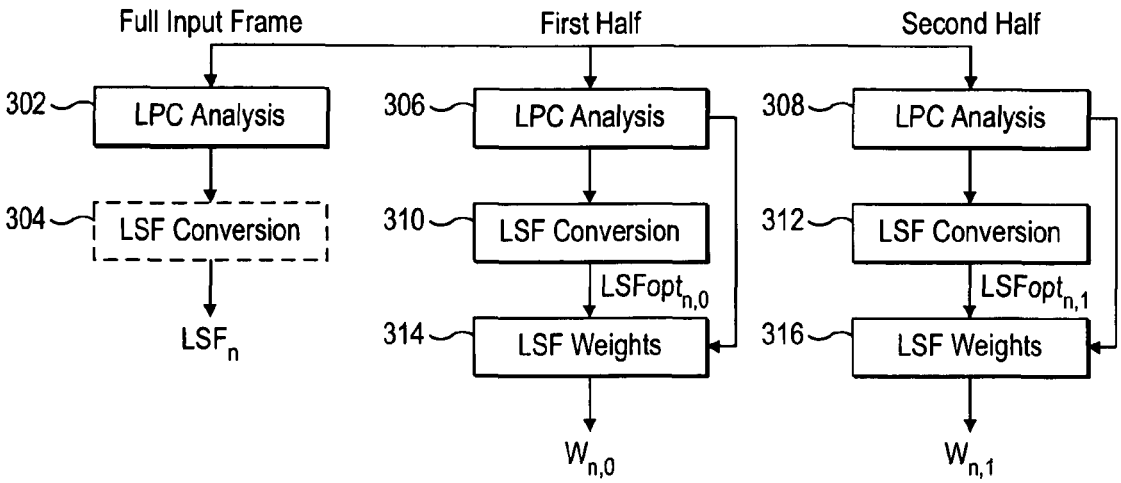
FIG. 3 illustrates the initial LPC analyses, conversion to LSF vectors and calculation of LSF error weight matrices according to an embodiment of the invention.

FIG. 3 illustrates the initial LPC analyses, conversion to LSF vectors, and calculation of LSF error weight matrices. The full input frame is subjected to LPC analysis 302. The LSF conversion of the full frame LPC coefficients 304 is calculated only when the interpolation factor is determined to be one, and no interpolation is applied.

In addition to the full frame LPC vector for frame n, say, $LPC_n$, LPC vectors are also calculated for the first half, $LPC_{n,0}$ at 306, and for the second half, $LPC_{n,1}$ at 308. The LPC coefficients do not quantize nor interpolate well, so prior to interpolation the LPC vectors are converted to LSF vectors at 310 and 312, which are better suited for this purpose, thus providing $LSFopt_{n,0}$ and $LSFopt_{n,1}$, respectively. The half frame coefficients are first used to find diagonal error weight matrices $W_{n,0}$ and $W_{n,1}$ at 314 and 316. The error weight matrices map errors in the LSF domain to residual energy.

Next, the optimum half frame LSF vectors $LSFopt_{n,0}$ and $LSFopt_{n,1}$ are used as targets for the estimation of the optimum vectors in the interpolation scheme. To keep the rate low, a parametric model is enforced on the LSF coefficients, $$LSF_{n,0}=(1-i)\cdot LSF_{n-1,1}+i\cdot LSF_{n,1},$$

where the interpolated first half frame LSF vector, that is, $LSF_{n,0}$ is a weighted average, described by the interpolation factor i, of the second half LSF vector from the previous frame $LSF_{n-1,1}$ and the second half LSF vector $LSF_{n,1}$ from the current frame. Given this parametric model, equations for the optimum model parameters are derived by minimizing the full frame residual energy, with the interpolation and the second half frame LSF vector as the unknown variables, i.e., $$\left\langle \begin{matrix} LSF_{n,1} \\ i \end{matrix} \right\rangle = \operatorname{argmin}_{LSF_{n,1},i} \left\{ \begin{matrix} (LSF_{n,0}-LSFopt_{n,0})^T W_{n,0}(LSF_{n,0}-LSFopt_{n,0})+ \\ (LSF_{n,1}-LSFopt_{n,1})^T W_{n,1}(LSF_{n,1}-LSFopt_{n,1}) \end{matrix} \right\}.$$

In this equation we substitute the interpolated $LSF_{n,0}$ by expressing it in terms of the interpolation factor and the second half LSF vectors for the previous and the current frame, that is, $$\left\langle \begin{matrix} LSF_{n,1} \\ i \end{matrix} \right\rangle = \operatorname{argmin}_{LSF_{n,1},i} \left\{ \begin{matrix} ((1-i)\cdot LSF_{n-1,1}+i\cdot LSF_{n,1}-LSFopt_{n,0})^T W_{n,0}\cdot \\ ((1-i)\cdot LSF_{n-1,1}+i\cdot LSF_{n,1}-LSFopt_{n,0})+ \\ (LSF_{n,1}-LSFopt_{n,1})^T W_{n,1}(LSF_{n,1}-LSFopt_{n,1}) \end{matrix} \right\}.$$

Figure 4:
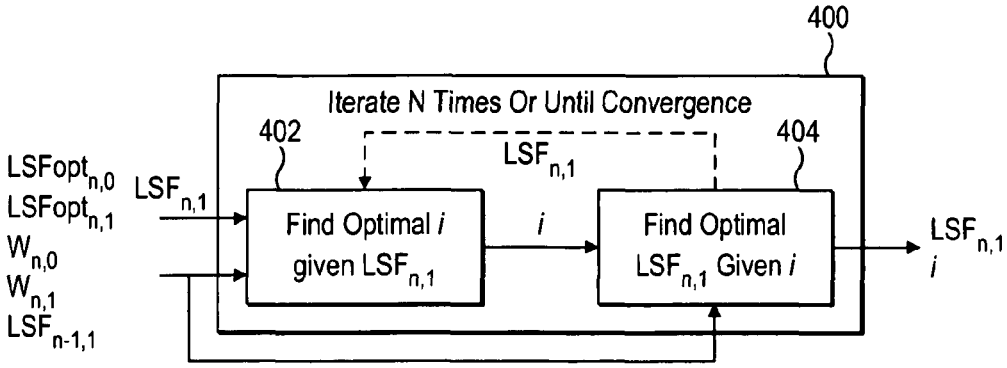
FIG. 4 illustrates an alternating optimization procedure for optimizing an interpolation value according to an embodiment of the invention.

This results in an optimization problem where a bi-convex objective function needs to be minimized. FIG. 4 shows an iterative algorithm 400 for finding the optimized interpolation factor i and the LSF vector $LSF_{n,1}$. The stationary points of the objective function are found for $LSF_{n,1}$ when i is treated as a constant in block 404, and for i when $LSF_{n,1}$ is treated as a vector of constants in block 402. Each of these tasks results in a closed form equation for the optimum solution for one given the other being constant. Using these equations the optimization problem may be solved in real-time in an iterative manner by low-complexity alternating optimization, which means that given either one of the interpolation factor i and the last half frame LSF vector $LSF_{n,1}$, evaluating the obtained closed form equations provides a value for the LSF vector $LSF_{n,1}$, or the interpolation factor i respectively.

In the second last iteration or when the alternating optimization has converged, the interpolation factor is quantized and the optimum second half LSF vector is estimated given this finally chosen value.

Whenever it is determined in closed loop analysis that LSF interpolation does not lead to a lower residual energy for the given frame, an interpolation factor i equal to one is used, resulting in $LSF_{n,1}$ of the parametric model describing the full frame. In this case, LSF conversion of the LPC analysis for the full input frame is performed. $LSF_{n,1}$ is then set equal to the vector that was obtained from the full frame analysis, i.e., $LSF_n$.

Figure 5:
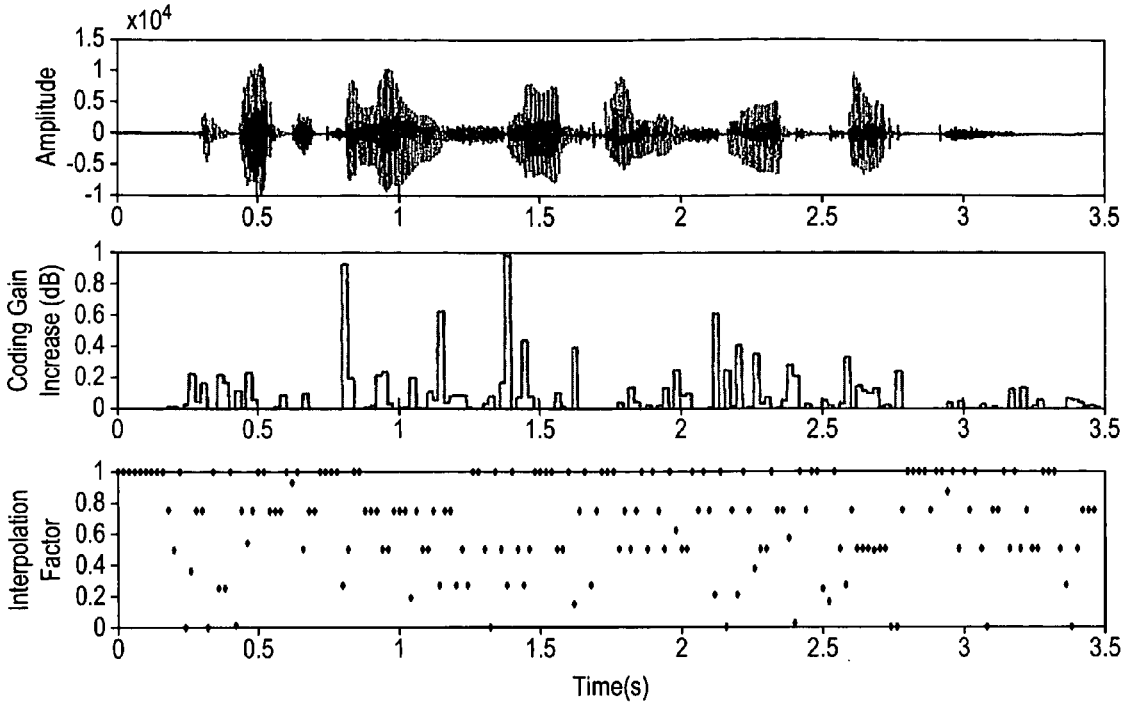
FIG. 5 shows an example speech signal, along with the coding gain increase and the optimum interpolation factors using an embodiment of the invention.
Figure 6:
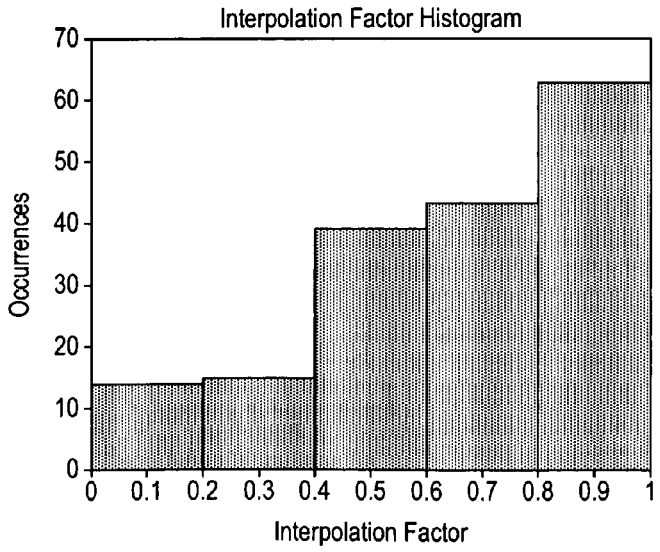
FIG. 6 shows a histogram of the interpolation factors for the example shown in FIG. 4.

An example where the interpolation scheme is applied is shown in FIG. 5, and FIG. 6. In this example, FIG. 6 shows that the LSF interpolation factor is different from 1 in 65% of the frames, indicating that the described interpolation method results in lower residual energy per frame, and therefore improved coding efficiency for a majority of frames. As can be seen in FIG. 5, the largest improvements in coding gain are seen during speech transitions.

Figure 7:
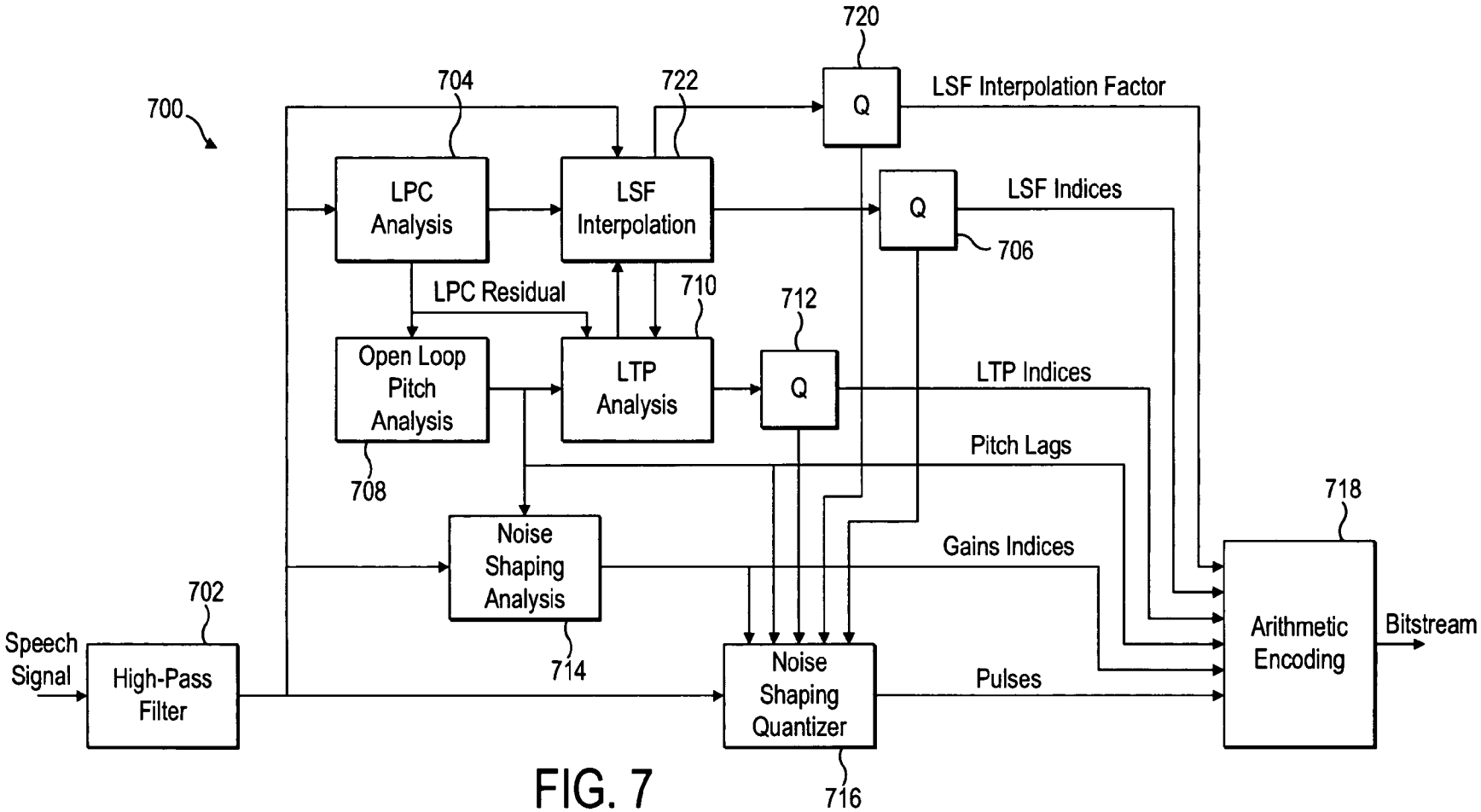
FIG. 7 shows an encoder according to an embodiment of the invention.

FIG. 7 shows an encoder 700 that can be used to encode a speech signal. The encoder 700 of FIG. 7 comprises a high-pass filter 702, a linear predictive coding (LPC) analysis block 704, a line spectral frequency (LSF) interpolation block 722, a scalar quantizer 720, a vector quantizer 706, an open-loop pitch analysis block 708, a long-term prediction (LTP) analysis block 710, a second vector quantizer 712, a noise shaping analysis block 714, a noise shaping quantizer 716, and an arithmetic encoding block 718.

The high pass filter 702 has an input arranged to receive an input speech signal from an input device such as a microphone, and an output coupled to inputs of the LPC analysis block 704, noise shaping analysis block 714 and noise shaping quantizer 716. The LPC analysis block 704 has an output coupled to an input of the LSF interpolation block 722. The LSF interpolation block 722 has outputs coupled to inputs of the scalar quantizer 720, the first vector quantizer 706 and the LTP analysis block 710. The scalar quantizer 720, and the first vector quantizer 706 each have outputs coupled to inputs of the arithmetic encoding block 718 and noise shaping quantizer 716.

The LPC analysis block 704 has outputs coupled to inputs of the open-loop pitch analysis block 708 and the LTP analysis block 710. The LTP analysis block 710 has an output coupled to an input of the second vector quantizer 712, and the second vector quantizer 712 has outputs coupled to inputs of the arithmetic encoding block 718 and noise shaping quantizer 716. The open-loop pitch analysis block 708 has outputs coupled to inputs of the LTP analysis block 710 and the noise shaping analysis block 714. The noise shaping analysis block 714 has outputs coupled to inputs of the arithmetic encoding block 718 and the noise shaping quantizer 716. The noise shaping quantizer 716 has an output coupled to an input of the arithmetic encoding block 718. The arithmetic encoding block 718 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes, and has a bit rate that varies depending on a quality setting provided to the encoder and on the complexity and estimated perceptual importance of the input signal.

The speech input signal is input to the high-pass filter 704 to remove frequencies below 80 Hz which contain almost no speech energy and may contain noise that can be detrimental to the coding efficiency and cause artifacts in the decoded output signal. The high-pass filter 704 is preferably a second order auto-regressive moving average (ARMA) filter.

The high-pass filtered input $x_{HP}$ is input to the linear prediction coding (LPC) analysis block 704, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

LPC analysis is performed for the full frame, $LPC_n$ and also for each half of the frame, $LPC_{n,0}$ and $LPC_{n,1}$, as described above.

The LPC coefficients vectors are input to the LSF interpolation block, which transforms the LPC coefficients to LSF vectors, and performs the interpolation optimization to generate an interpolation factor and a LSF vector representing the frame.

The resulting LSF vector is quantized using the second vector quantizer 706, a multi-stage vector quantizer (MSVQ) with 10 stages, producing 10 LSF indices that together represent the quantized LSFs. The quantized LSFs are transformed back to produce the quantized LPC coefficients $a_Q$ for each half of the frame using the estimated interpolation factor and the previously transmitted LSF vector, for use in the noise shaping quantizer 716.

The LSF interpolation factor is quantized using the first vector quantizer 720 and the quantized LSF interpolation factor is input to arithmetic encoding block 718.

The LPC residual is input to the open loop pitch analysis block 708, producing one pitch lag for every 5 millisecond subframe, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 718 and noise shaping quantizer 716.

For voiced frames, a long-term prediction analysis is performed on the LPC residual. The LPC residual $r_{LPC}$ is supplied from the LPC analysis block 704 to the LTP analysis block 710. For each subframe, the LTP analysis block 710 solves normal equations to find 5 linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n - \text{lag} - i)b_i$$

is minimized.

The LTP coefficients for each frame are quantized using a vector quantizer (VQ). The resulting VQ codebook index is input to the arithmetic coder, and the quantized LTP coefficients $b_Q$ are input to the noise shaping quantizer.

The high-pass filtered input is analyzed by the noise shaping analysis block 714 to find filter coefficients and quantization gains used in the noise shaping quantizer. The filter coefficients determine the distribution over the quantization noise over the spectrum, and are chose such that the quantization is least audible. The quantization gains determine the step size of the residual quantizer and as such govern the balance between bitrate and quantization noise level.

All noise shaping parameters are computed and applied per subframe of 5 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetically encoder 718. The quantized quantization gains are input to the noise shaping quantizer 716.

Next a set of short-term noise shaping coefficients $a_{shape,i}$ are found by applying bandwidth expansion to the coefficients found in the noise shaping LPC analysis. This bandwidth expansion moves the roots of the noise shaping LPC polynomial towards the origin, according to the formula:

$$a_{shape,i}=a_{autocorr,i}g^i$$

where $a_{autocorr,i}$ is the ith coefficient from the noise shaping LPC analysis and for the bandwidth expansion factor g a value of 0.94 was found to give good results.

For voiced frames, the noise shaping quantizer also applies long-term noise shaping. It uses three filter taps, described by:

$$b_{shape}=0.5\ \mathrm{sqrt(PitchCorrelation)}[0.25,0.5,0.25].$$

The short-term and long-term noise shaping coefficients are input to the noise shaping quantizer 716. The high-pass filtered input is also input to the noise shaping quantizer 716.

Figure 8:
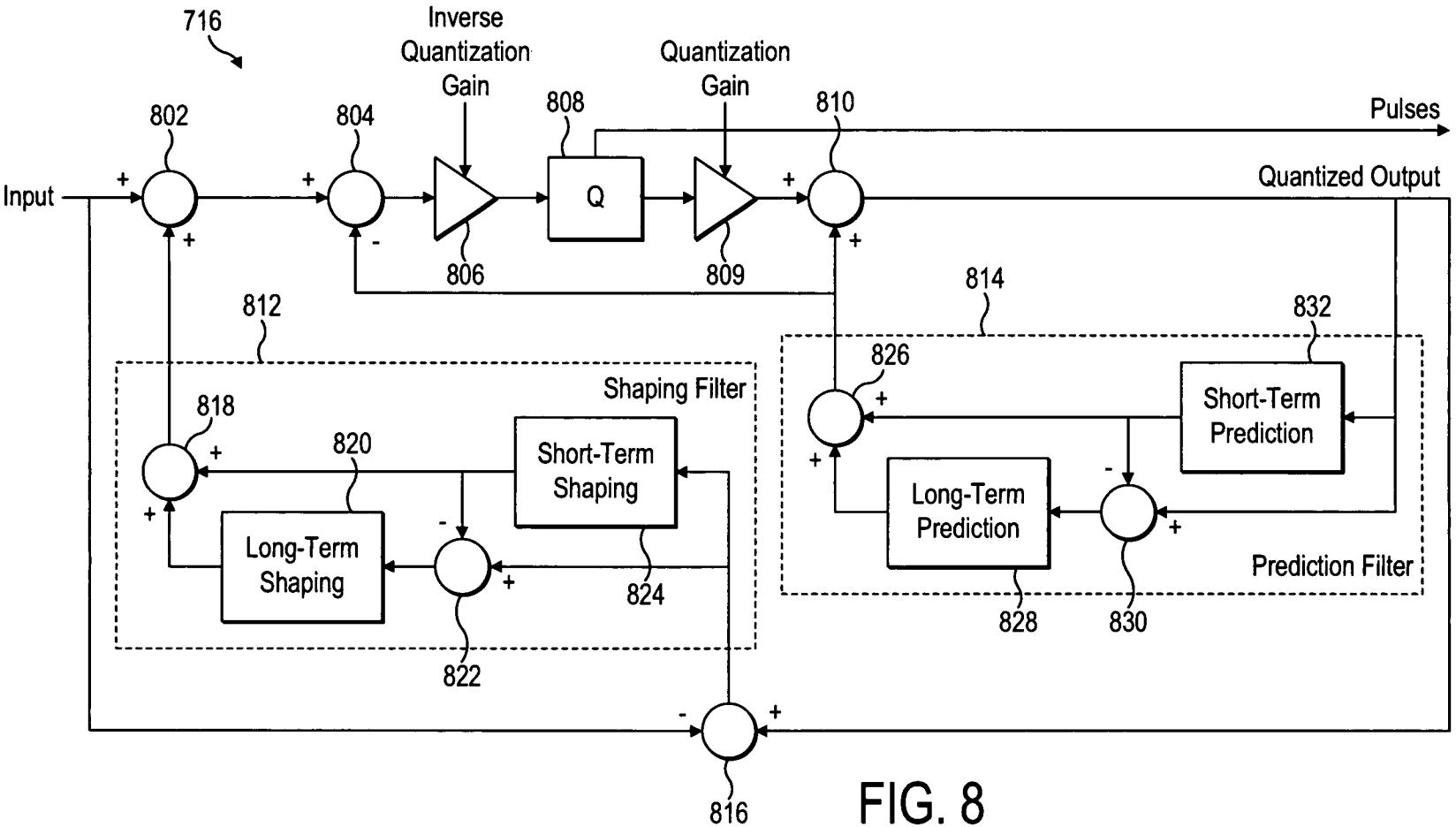
FIG. 8 shows a noise shaping quantizer according to an embodiment of the invention.

An example of the noise shaping quantizer 716 is now discussed in relation to FIG. 8.

The noise shaping quantizer 716 comprises a first addition stage 802, a first subtraction stage 804, a first amplifier 806, a scalar quantizer 808, a second amplifier 809, a second addition stage 810, a shaping filter 812, a prediction filter 814 and a second subtraction stage 816. The shaping filter 812 comprises a third addition stage 818, a long-term shaping block 820, a third subtraction stage 822, and a short-term shaping block 824. The prediction filter 814 comprises a fourth addition stage 826, a long-term prediction block 828, a fourth subtraction stage 830, and a short-term prediction block 832.

The first addition stage 802 has an input arranged to receive the high-pass filtered input from the high-pass filter 702, and another input coupled to an output of the third addition stage 818. The first subtraction stage has inputs coupled to outputs of the first addition stage 802 and fourth addition stage 826. The first amplifier has a signal input coupled to an output of the first subtraction stage and an output coupled to an input of the scalar quantizer 808. The first amplifier 806 also has a control input coupled to the output of the noise shaping analysis block 714. The scalar quantiser 808 has outputs coupled to inputs of the second amplifier 809 and the arithmetic encoding block 718. The second amplifier 809 also has a control input coupled to the output of the noise shaping analysis block 714, and an output coupled to the an input of the second addition stage 810. The other input of the second addition stage 810 is coupled to an output of the fourth addition stage 826. An output of the second addition stage is coupled back to the input of the first addition stage 802, and to an input of the short-term prediction block 832 and the fourth subtraction stage 830. An output of the short-tem prediction block 832 is coupled to the other input of the fourth subtraction stage 830. The fourth addition stage 826 has inputs coupled to outputs of the long-term prediction block 828 and short-term prediction block 832. The output of the second addition stage 810 is further coupled to an input of the second subtraction stage 816, and the other input of the second subtraction stage 816 is coupled to the input from the high-pass filter 702. An output of the second subtraction stage 816 is coupled to inputs of the short-term shaping block 824 and the third subtraction stage 822. An output of the short-tem shaping block 824 is coupled to the other input of the third subtraction stage 822. The third addition stage 818 has inputs coupled to outputs of the long-term shaping block 820 and short-term prediction block 824.

The purpose of the noise shaping quantizer 716 is to quantize the LTP residual signal in a manner that weights the distortion noise created by the quantisation into parts of the frequency spectrum where the human ear is more tolerant to noise.

In operation, all gains and filter coefficients and gains are updated for every subframe, except for the LPC coefficients, which are updated once per frame. The noise shaping quantizer 716 generates a quantized output signal that is identical to the output signal ultimately generated in the decoder. The input signal is subtracted from this quantized output signal at the second subtraction stage 616 to obtain the quantization error signal d(n). The quantization error signal is input to a shaping filter 812, described in detail later. The output of the shaping filter 812 is added to the input signal at the first addition stage 802 in order to effect the spectral shaping of the quantization noise. From the resulting signal, the output of the prediction filter 814, described in detail below, is subtracted at the first subtraction stage 804 to create a residual signal. The residual signal is multiplied at the first amplifier 806 by the inverse quantized quantization gain from the noise shaping analysis block 714, and input to the scalar quantizer 808. The quantization indices of the scalar quantizer 808 represent an excitation signal that is input to the arithmetically encoder 718. The scalar quantizer 808 also outputs a quantization signal, which is multiplied at the second amplifier 809 by the quantized quantization gain from the noise shaping analysis block 714 to create an excitation signal. The output of the prediction filter 814 is added at the second addition stage to the excitation signal to form the quantized output signal. The quantized output signal is input to the prediction filter 814.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is the output.

The shaping filter 812 inputs the quantization error signal d(n) to a short-term shaping filter 824, which uses the short-term shaping coefficients $a_{shape,i}$ to create a short-term shaping signal $s_{short}(n)$, according to the formula:

$$s_{short}(n)=\sum_{i=1}^{16} d(n-i)a_{shape,i}.$$

The short-term shaping signal is subtracted at the third addition stage 822 from the quantization error signal to create a shaping residual signal f(n). The shaping residual signal is input to a long-term shaping filter 820 which uses the long-term shaping coefficients $b_{shape,i}$ to create a long-term shaping signal $s_{long}(n)$, according to the formula:

$$s_{long}(n) = \sum_{i=-2}^{2} f(n - \text{lag} - i) b_{shape,i}.$$

The short-term and long-term shaping signals are added together at the third addition stage 818 to create the shaping filter output signal.

The prediction filter 814 inputs the quantized output signal y(n) to a short-term prediction filter 832, which uses the quantized LPC coefficients $a_Q$ to create a short-term prediction signal $p_{short}(n)$, according to the formula:

$$p_{short}(n) = \sum_{i=1}^{16} y(n - i) a_Q(i).$$

The short-term prediction signal is subtracted at the fourth subtraction stage 830 from the quantized output signal to create an LPC excitation signal $e_{LPC}(n)$. The LPC excitation signal is input to a long-term prediction filter 828 which uses the quantized long-term prediction coefficients $b_Q$ to create a long-term prediction signal $p_{long}(n)$, according to the formula:

$$p_{long}(n) = \sum_{i=-2}^{2} e_{LPC}(n - \text{lag} - i) b_Q(i).$$

The short-term and long-term prediction signals are added together at the fourth addition stage 826 to create the prediction filter output signal.

The LSF indices, LSF interpolation factor, LTP indices, quantization gains indices, pitch lags and the excitation quantization indices are each arithmetically encoded and multiplexed by the arithmetic encoder 718 to create the payload bitstream. The arithmetic encoder 718 uses a look-up table with probability values for each index. The look-up tables are created by running a database of speech training signals and measuring frequencies of each of the index values. The frequencies are translated into probabilities through a normalization step.

Figure 9:
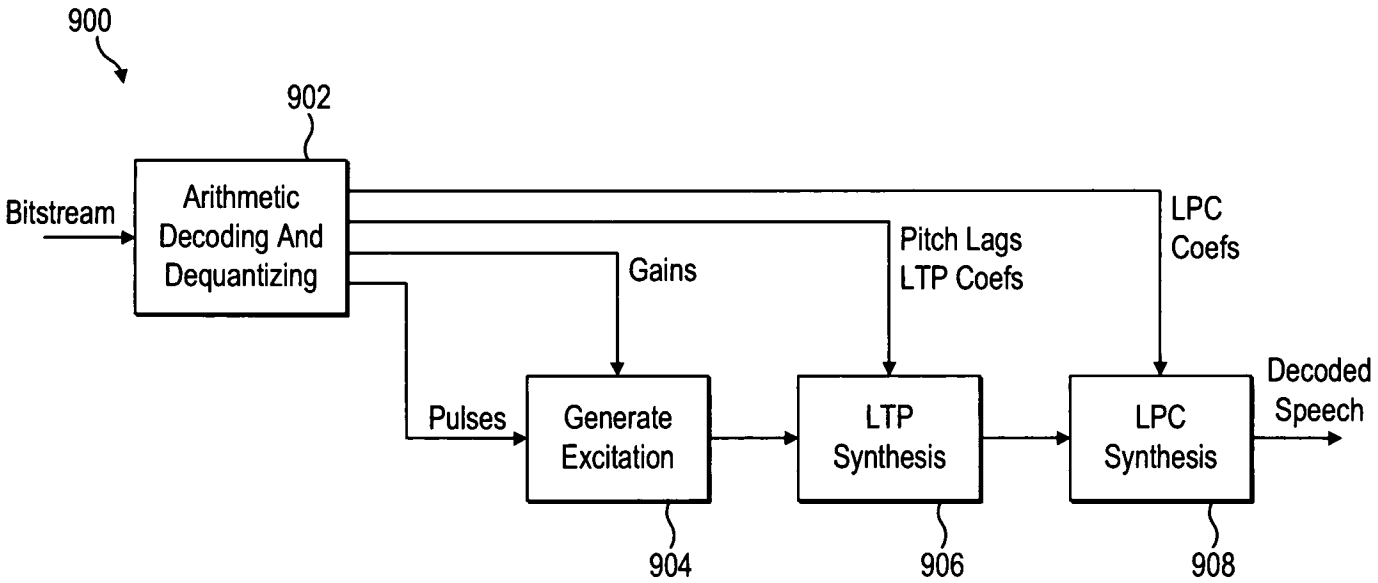
FIG. 9 shows a decoder suitable for decoding a signal encoded using the encoder of FIG. 5.

An example decoder 900 for use in decoding a signal encoded according to embodiments of the present invention is now described in relation to FIG. 9.

The decoder 900 comprises an arithmetic decoding and dequantizing block 902, an excitation generation block 904, an LTP synthesis filter 906, and an LPC synthesis filter 908. The arithmetic decoding and dequantizing block 902 has an input arranged to receive an encoded bitstream from an input device such as a wired modem or wireless transceiver, and has outputs coupled to inputs of each of the excitation generation block 904, LTP synthesis filter 906 and LPC synthesis filter 908. The excitation generation block 904 has an output coupled to an input of the LTP synthesis filter 906, and the LTP synthesis block 906 has an output connected to an input of the LPC synthesis filter 908. The LPC synthesis filter has an output arranged to provide a decoded output for supply to an output device such as a speaker or headphones.

At the arithmetic decoding and dequantizing block 902, the arithmetically encoded bitstream is demultiplexed and decoded to create LSF indices, LSF interpolation factor, LTP codebook index and LTP indices, quantization gains indices, pitch lags and a signal of excitation quantization indices. The LSF indices are converted to quantized LSFs by adding the codebook vectors, one from each of the ten stages of the MSVQ. Using the interpolation factor and the transmitted LSF vector for the previous frame, the quantized LSFs are obtained for each frame half. The two sets of quantized LSFs are then transformed to quantized LPC coefficients.

The LTP codebook index is used to select an LTP codebook, which is then used to convert the LTP indices to quantized LTP coefficients. The gains indices are converted to quantization gains, through look ups in the gain quantization codebook. The LTP indices and gains indices are converted to quantized LTP coefficients and quantization gains, through look ups in the quantization codebooks.

At the excitation generation block, the excitation quantization indices signal is multiplied by the quantization gain to create an excitation signal e(n).

The excitation signal is input to the LTP synthesis filter 906 to create the LPC excitation signal $e_{ltp}(n)$ according to:

$$e_{LTP}(n) = e(n) + \sum_{i=-2}^{2} e(n - \text{lag} - i) b_Q(i),$$

using the pitch lag and quantized LTP coefficients $b_Q$.

The long term excitation signal is input to the LPC synthesis filter to create the decoded speech signal y(n) according to:

$$y(n) = e_{LPC}(n) + \sum_{i=1}^{16} e_{LPC}(n - i) a_Q(i),$$

using the quantized LPC coefficients $a_Q$.

For the first half of the frame synthesis is performed using the coefficients obtained from the interpolated $LSF_{n,0}$ and for the second half we use the coefficients obtained from $LSF_{n,1}$.

The encoder 700 and decoder 900 are preferably implemented in software, such that each of the components 702 to 832 and 902 to 908 comprise modules of software stored on one or more memory devices and executed on a processor. A preferred application of the present invention is to encode speech for transmission over a packet-based network such as the Internet, preferably using a peer-to-peer (P2P) system implemented over the Internet, for example as part of a live call such as a Voice over IP (VoIP) call. In this case, the encoder 700 and decoder 900 are preferably implemented in client application software executed on end-user terminals of two users communicating over the P2P system.

An advantage of some embodiments of the invention over the prior art is that the spectral fluctuations are reduced by interpolation only when there is an actual gain from doing it. Embodiments of the invention are generalizations of the regular method of having a single spectral model for each frame, and have a very low cost in terms of bit-rate. A further advantage is that the decoded spectral envelope matches that of the input better, over time. This provides better sound quality of the decoded signal, and reduces the energy of the residual signal, which consequently can be coded more efficiently, reducing the bit-rate.

The improvement is generally biggest during a transition. If the transition happens around the middle of the frame it is advantageous to use LSFs close to those of the previous frame for the first half of the frame, and new ones for the second half. On the contrary, if the transition happens around the start of the frame, it is better to use the same LSFs for the entire frame and have no interpolation at all. Having a variable interpolation factor enables this form of adaptation.

According to embodiments of the invention, a closed loop interpolation scheme is used that will deviate from the regular approach only when it leads to better performance to do so. The model is always applied, but as it generalizes the regular approach, there is a mode with the interpolation factor equal to 1 where it performs exactly as the regular approach except for the small bit-rate increase from transmitting the scalar interpolation factor. In this context, "the regular approach" is where one constant LPC vector is used per frame, or alternatively, a transmitted LPC vector is used for the second half of the frame, and a LPC vector is interpolated with a constant interpolation factor from the transmitted LPC vector and the LPC vector from the previous frame.

As embodiments of the invention generalize the regular approach, the performance for each frame is guaranteed to be no worse than the regular approach, except for the increase in bit-rate from sending an additional scalar value for each frame. The transmitted LSF vector can be optimized given the applied model and the estimated interpolation factor.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

According to the invention in certain embodiments there is provided an encoder as herein described having the following features.

The first signal-processing module may be further configured to derive optimal line spectral frequency vectors for the first and second portions of the frame.

The second signal-processing module may be further configured to determine the transmit line spectral frequency vector and the interpolation factor based on minimizing a difference between the second line spectral frequency vector and the transmit line spectral frequency vector and between the first line spectral frequency vector and an interpolated line spectral frequency vector based on the interpolation factor and the transmit line spectral frequency vector.

The minimizing of a difference may comprise minimizing a residual energy for the frame.

The second signal-processing module may be further configured to alternately calculate the transmit line spectral frequency vector for a constant interpolation factor and then the interpolation factor for the calculated transmit line spectral frequency vector for a plurality of iterations.

The second signal-processing module may be configured to alternately calculate the transmit line spectral frequency vector for a constant interpolation factor and then the interpolation factor for the calculated transmit line spectral frequency vector until the calculation converges on optimum values for the interpolation factor and the line spectral frequency vector.

The plurality of iterations may comprise a pre-defined number of iterations.

The encoder may comprise an arithmetic encoder configured to arithmetically encode the interpolation factor and the transmit line spectral frequency vector.

The encoder may comprise a multiplexer configured to multiplex the encoded interpolation factor and transmit line spectral frequency vector into a bit stream for transmission.

According to the invention in certain embodiments there is provided a decoder as herein described having the feature that the signal-processing module is further configured to generate a decoded speech signal based on the received line spectral frequency vector and the interpolated line spectral frequency vector.

The invention claimed is:

1. A method of determining line spectral frequency vectors representing filter coefficients for a time-varying filter for encoding speech according to a source-filter model, whereby speech is modeled to comprise a source signal filtered by the time-varying filter, the method comprising:

receiving a speech signal comprising successive frames;

for each of a plurality of frames of the speech signal, deriving a first line spectral frequency vector for a first portion of the frame, and a second line spectral frequency vector for a second portion of the frame; and calculating a transmit line spectral frequency vector and an interpolation factor based on the first and second line spectral frequency vectors, and on the transmit line spectral frequency vector for a preceding one of the frames, wherein calculating the transmit line spectral frequency vector and the interpolation factor is based on minimizing a difference between the second line spectral frequency vector and the transmit line spectral frequency vector and between the first line spectral frequency vector and an interpolated line spectral frequency vector based on the interpolation factor and the transmit line spectral frequency vector, the minimizing a difference based, at least in part, upon minimizing a residual energy for the frame.

2. The method according to claim 1, wherein the first and second line spectral frequency vectors comprise optimal line spectral frequency vectors for the first and second portions of the frame.

3. The method according to claim 1, wherein the first portion of the frame comprises a first half of the frame, and the second portion of the frame comprises a second half of the frame.

4. The method according to claim 1, wherein said calculating comprises alternately calculating the transmit line spectral frequency vector for a constant interpolation factor and then the interpolation factor for the calculated transmit line spectral frequency vector for a plurality of iterations.

5. The method of claim 4 comprising alternately calculating the transmit line spectral frequency vector for a constant interpolation factor and then the interpolation factor for the calculated transmit line spectral frequency vector until the calculation converges on optimum values for the interpolation factor and the line spectral frequency vector.

6. The method of claim 5 wherein said plurality of iterations comprises a pre-defined number of iterations.

7. The method of claim 1 further comprising arithmetically encoding the interpolation factor and the transmit line spectral frequency vector.

8. The method of claim 7 further comprising multiplexing the encoded interpolation factor and transmit line spectral frequency vector into a bit stream for transmission.

9. An encoder for encoding speech according to a source-filter model whereby speech is modeled to comprise a source signal filtered by a time-varying filter, the encoder comprising:

an input arranged to receive a speech signal comprising successive frames;

a first signal-processing module configured to derive, for each of a plurality of frames of the speech signal, a first line spectral frequency vector for a first portion of the frame, and a second line spectral frequency vector for a second portion of the frame; and a second signal-processing module configured to calculate a transmit line spectral frequency vector and an interpolation factor based on the first and second line spectral frequency vectors, and on the transmit line spectral frequency vector for a preceding one of the frames, wherein the second signal-processing module is further configured to calculate the transmit line spectral frequency vector and the interpolation factor based, at least in part, on minimizing a difference between the second line spectral frequency vector and the transmit line spectral frequency vector and between the first line spectral frequency vector and an interpolated line spectral frequency vector based on the interpolation factor and the transmit line spectral frequency vector, the minimizing a difference is based, at least in part, upon minimizing a residual energy for the frame.

10. A computer program product stored on one or more memory devices for determining line spectral frequency vectors representing filter coefficients for a time-varying filter for encoding speech according to a source-filter model, whereby the speech is modeled to comprise a source signal filtered by a time-varying filter, the computer program product comprising one or more computer-readable instructions configured, so as when executed on a processor, to:

receive a speech signal comprising successive frames;

for each of a plurality of frames of the speech signal, derive a first line spectral frequency vector for a first portion of the frame, and a second line spectral frequency vector for a second portion of the frame; and calculate a transmit line spectral frequency vector and an interpolation factor based on the first and second line spectral frequency vectors, and on the transmit line spectral frequency vector for a preceding one of the frames, wherein to calculate the transmit line spectral frequency vector and the interpolation factor based, at least in part, on minimizing a difference between the second line spectral frequency vector and the transmit line spectral frequency vector and between the first line spectral frequency vector and an interpolated line spectral frequency vector based on the interpolation factor and the transmit line spectral frequency vector, the minimizing a difference is based, at least in part, upon minimizing a residual energy for the frame.

11. The encoder of claim 9, wherein the second signal-processing module is configured to alternately calculate the transmit line spectral frequency vector for a constant interpolation factor and then calculate the interpolation factor for the calculated transmit line spectral frequency vector until the calculation converges on optimum values for the interpolation factor and the line spectral frequency vector.

12. The encoder of claim 9 further comprising an arithmetic encoder configured to arithmetically encode the interpolation factor and the transmit line spectral frequency vector.

13. The encoder of claim 12 further comprising a multiplexer configured to multiplex said encoded interpolation factor and transmit line spectral frequency vector into a bit stream for transmission.

14. The computer program product of claim 10, wherein the computer-readable instructions are further configured to convert optimal line spectral frequency vectors for the first and second portions of the frame from linear prediction coefficients.

15. The computer program product of claim 10, wherein the computer-readable instructions are further configured to alternately calculate the transmit line spectral frequency vector for a constant interpolation factor and then the interpolation factor for the calculated transmit line spectral frequency vector for a plurality of iterations.

16. The computer program product of claim 10, wherein the plurality of iterations comprises a pre-defined number of iterations.

17. A method of determining line spectral frequency vectors representing filter coefficients for a time-varying filter for encoding speech according to a source-filter model, whereby speech is modeled to comprise a source signal filtered by the time-varying filter, the method comprising:

receiving a speech signal comprising successive frames;

for each of a plurality of frames of the speech signal, deriving a first line spectral frequency vector for a first portion of the frame, and a second line spectral frequency vector for a second portion of the frame; and calculating a transmit line spectral frequency vector and an interpolation factor based on the first and second line spectral frequency vectors, and on the transmit line spectral frequency vector for a preceding one of the frames, wherein calculating the transmit line spectral frequency vector and the interpolation factor is based, at least in part, on minimizing a residual energy for the frame.

18. An encoder for encoding speech according to a source-filter model whereby speech is modeled to comprise a source signal filtered by a time-varying filter, the encoder comprising:

an input arranged to receive a speech signal comprising successive frames;

a first signal-processing module configured to derive, for each of a plurality of frames of the speech signal, a first line spectral frequency vector for a first portion of the frame, and a second line spectral frequency vector for a second portion of the frame; and a second signal-processing module configured to calculate a transmit line spectral frequency vector and an interpolation factor based on the first and second line spectral frequency vectors, and on the transmit line spectral frequency vector for a preceding one of the frames, wherein the second signal-processing module is further configured to alternately calculate the transmit line spectral frequency vector for a constant interpolation factor and then calculate the interpolation factor for the calculated transmit line spectral frequency vector until the calculation converges on optimum values for the interpolation factor and the line spectral frequency vector.

19. An encoder for encoding speech according to a source-filter model whereby speech is modeled to comprise a source signal filtered by a time-varying filter, the encoder comprising:

an input arranged to receive a speech signal comprising successive frames;

a first signal-processing module configured to derive, for each of a plurality of frames of the speech signal, a first line spectral frequency vector for a first portion of the frame, and a second line spectral frequency vector for a second portion of the frame; and a second signal-processing module configured to calculate a transmit line spectral frequency vector and an interpolation factor based on the first and second line spectral frequency vectors, and on the transmit line spectral frequency vector for a preceding one of the frames, wherein the second signal-processing module is further configured to alternately calculate the transmit line spectral frequency vector for a constant interpolation factor and then the interpolation factor for the calculated transmit line spectral frequency vector for a plurality of iterations.

20. A computer program product stored on one or more memory devices for determining line spectral frequency vectors representing filter coefficients for a time-varying filter for encoding speech according to a source-filter model, whereby the speech is modeled to comprise a source signal filtered by a time-varying filter, the computer program product comprising one or more computer-readable instructions configured, so as when executed on a processor, to:

receive a speech signal comprising successive frames;

for each of a plurality of frames of the speech signal, derive a first line spectral frequency vector for a first portion of the frame, and a second line spectral frequency vector for a second portion of the frame; and calculate a transmit line spectral frequency vector and an interpolation factor based on the first and second line spectral frequency vectors, and on the transmit line spectral frequency vector for a preceding one of the frames, wherein the instructions are further configured to alternately calculate the transmit line spectral frequency vector for a constant interpolation factor and then the interpolation factor for the calculated transmit line spectral frequency vector for a plurality of iterations.

21. A method of determining line spectral frequency vectors representing filter coefficients for a time-varying filter for encoding speech according to a source-filter model, whereby speech is modeled to comprise a source signal filtered by the time-varying filter, the method comprising:

receiving a speech signal comprising successive frames;

for each of a plurality of frames of the speech signal, deriving a first line spectral frequency vector for a first portion of the frame, and a second line spectral frequency vector for a second portion of the frame; and calculating a transmit line spectral frequency vector and an interpolation factor based on the first and second line spectral frequency vectors, and on the transmit line spectral frequency vector for a preceding one of the frames, wherein calculating a transmit line spectral frequency vector and an interpolation factor further comprises alternately calculating the transmit line spectral frequency vector for a constant interpolation factor and then calculating the interpolation factor for the calculated transmit line spectral frequency vector until the calculation converges on optimum values for the interpolation factor and the line spectral frequency vector.

22. Computer-readable storage memory device embodying computer-executable instructions to determine line spectral frequency vectors representing filter coefficients for a time-varying filter for encoding speech according to a source-filter model, whereby speech is modeled to comprise a source signal filtered by the time-varying filter, wherein, responsive to execution by at least one processor, the computer-executable instructions are configured to:

receive a speech signal comprising successive frames;

for each of a plurality of frames of the speech signal, derive a first line spectral frequency vector for a first portion of the frame, and a second line spectral frequency vector for a second portion of the frame; and calculate a transmit line spectral frequency vector and an interpolation factor based on the first and second line spectral frequency vectors, and on the transmit line spectral frequency vector for a preceding one of the frames, wherein calculating the transmit line spectral frequency vector and the interpolation factor is based, at least in part, on minimizing a residual energy for the frame.

23. A system comprising:

at least one processor; and computer-readable storage memory embodying computer-executable instructions to determine line spectral frequency vectors representing filter coefficients for a time-varying filter for encoding speech according to a source-filter model, whereby speech is modeled to comprise a source signal filtered by the time-varying filter, wherein, responsive to execution by the at least one processor, the computer-executable instructions are configured to:

receive a speech signal comprising successive frames;

for each of a plurality of frames of the speech signal, derive a first line spectral frequency vector for a first portion of the frame, and a second line spectral frequency vector for a second portion of the frame; and calculate a transmit line spectral frequency vector and an interpolation factor based on the first and second line spectral frequency vectors, and on the transmit line spectral frequency vector for a preceding one of the frames, wherein calculating the transmit line spectral frequency vector and the interpolation factor is based, at least in part, on minimizing a residual energy for the frame.

* * * * *